US008516940B2

(12) United States Patent
Bruschi

(10) Patent No.: US 8,516,940 B2
(45) Date of Patent: Aug. 27, 2013

(54) ELECTRONIC PROGRAMMING SYSTEM FOR DETONATING FUSES

(75) Inventor: Andrea Bruschi, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 154 days.

(21) Appl. No.: 13/165,385

(22) Filed: Jun. 21, 2011

(65) Prior Publication Data

US 2011/0308415 A1 Dec. 22, 2011

(30) Foreign Application Priority Data

Jun. 22, 2010 (IT) ..... TO2010A000534

(51) Int. Cl.
*F42C 17/04* (2006.01)

(52) U.S. Cl.
USPC ..... 89/6.5

(58) Field of Classification Search
USPC ..... 89/6, 6.5
See application file for complete search history.

(56) References Cited

U.S. PATENT DOCUMENTS

| | | | | |
|---|---|---|---|---|
| 6,189,430 | B1 * | 2/2001 | Vornfett | 89/6.5 |
| 2003/0047063 | A1 * | 3/2003 | Sullivan | 89/6.5 |
| 2003/0136250 | A1 * | 7/2003 | Vornfett et al. | 89/6.5 |

FOREIGN PATENT DOCUMENTS

| | | |
|---|---|---|
| FR | 1 137 831 | 10/1955 |
| WO | WO 97/39304 | 10/1997 |
| WO | WO 01/67029 | 9/2001 |
| WO | WO 02/077564 | 10/2002 |

OTHER PUBLICATIONS

Italian Search Report for Application No. T020100534 mailed 25 Mar. 2011.

* cited by examiner

*Primary Examiner* — Stephen M Johnson
(74) *Attorney, Agent, or Firm* — Merchant & Gould P.C.

(57) ABSTRACT

An electronic programming system is for programmable ammunitions "M" implemented in a firearm (1). The system is adapted to send information to a detonating fuse of an ammunition "M", which stores the information inside it, and is adapted to receive information on the characteristics of the ammunition "M" from the detonating fuse. The programming system is directly implemented inside a firearm 1, including at least one firearm-control unit 2, adapted to control all the systems implemented in the firearm 1. The electronic programming system includes at least one actuation mechanism 4, adapted to provide an electrical coupling between the detonating fuse and the programming system, and a programmer-control device 3, which, via appropriate interfaces, manages the data flows for communication both with the detonating fuse and with firearm-control unit 2.

7 Claims, 6 Drawing Sheets

ELECTRONIC PROGRAMMING SYSTEM FOR DETONATING FUSES

This application claims benefit of Serial No. TO 2010 A 000534, filed 22 Jun. 2010 in Italy and which application is incorporated herein by reference. To the extent appropriate, a claim of priority is made to the above disclosed application.

BACKGROUND

The present invention relates to an electronic programming system for programmable ammunition, which, since they are provided, for example, with guide systems for target aiming and interception, have to be programmed before the deflagration of the ammunition itself by means of a firearm with medium-big caliber.

Said ammunition normally comprise, inside the detonating fuse, a plurality of electronic devices, which receive commands, store them and use them, for example, for locating a target or aiming at it.

Mechanical programming systems of the detonating fuses are already known in the technical field, such as for example the so-called "setter" systems, in which the detonating fuse is mechanically programmed to deflagrate after a predetermined amount of time.

There are, furthermore, programming systems of the detonating fuses which use electromagnetic waves, sent by suited transmitter devices, in order to transfer information to the electronic devices comprised in said detonating fuse.

Said electromagnetic waves are received by receiver devices, arranged inside the detonating fuse, programming in this way the detonating fuse itself.

These latter systems, which are normally applied on firearms with medium-big calibers, are not reliable, since the great number of electromechanical devices present in the firearm can cause interferences with said electromagnetic signal, thus generating a programming which is often wrong.

Finally, there are ammunition programming systems which send data to the electronic devices in the detonating fuse by means of a communication means, normally a cable. Said cables are terminated with a particular connector, which varies according to the communication standard implemented.

Said cable programming systems, even though much safer than the above-mentioned ones, require a great amount of time to perform said programming and, therefore, can hardly be automated and directly implemented on firearms with medium-big caliber. The difficulty to automate said systems is due to the standardized connectors, whose connection to the different detonating fuses to be programmed has to be mainly carried out by hand by an operator.

For this reason, the detonating fuses are not programmed when they are already placed in the firearm, for example in proximity to breech or in the firing chamber, but they are pre-programmed offline, before the ammunition are positioned in the firearm. The object of present invention is to solve the above-mentioned problems by providing a programming system of the detonating fuses for programmables ammunition, which can be directly implemented in the firearm by electrically establishing a contact between the detonating fuse and said system, thus remarkably reducing the programming errors of said detonating fuses and, furthermore, accelerating the programming procedure.

SUMMARY

The programming system according to the present invention allows the programming of said detonating fuses, by storing the desired information inside them, right before their firing, thus making the system highly flexible, since in this way it is possible to vary the programming of an ammunition with respect to the previous one according to the fighting plan, which is conceived according to the operating scenario, in a very fast way even in critical situations.

Moreover, the programming system according to the present invention is obtained by reducing the maneuver spaces, thus reducing, furthermore, the execution time needed to perform said programming, since the programming is performed in parallel with other operating steps of the systems implemented in the firearm, thus increasing the firing frequency.

An aspect of the present invention relates to a programming system of the detonating fuses of programmable ammunition.

BRIEF DESCRIPTION OF THE DRAWINGS

The features and advantages of said system will be more clear from the following description of an embodiment with reference to the accompanying drawings, which specifically illustrate what follows.

DETAILED DESCRIPTION

Figure 1:
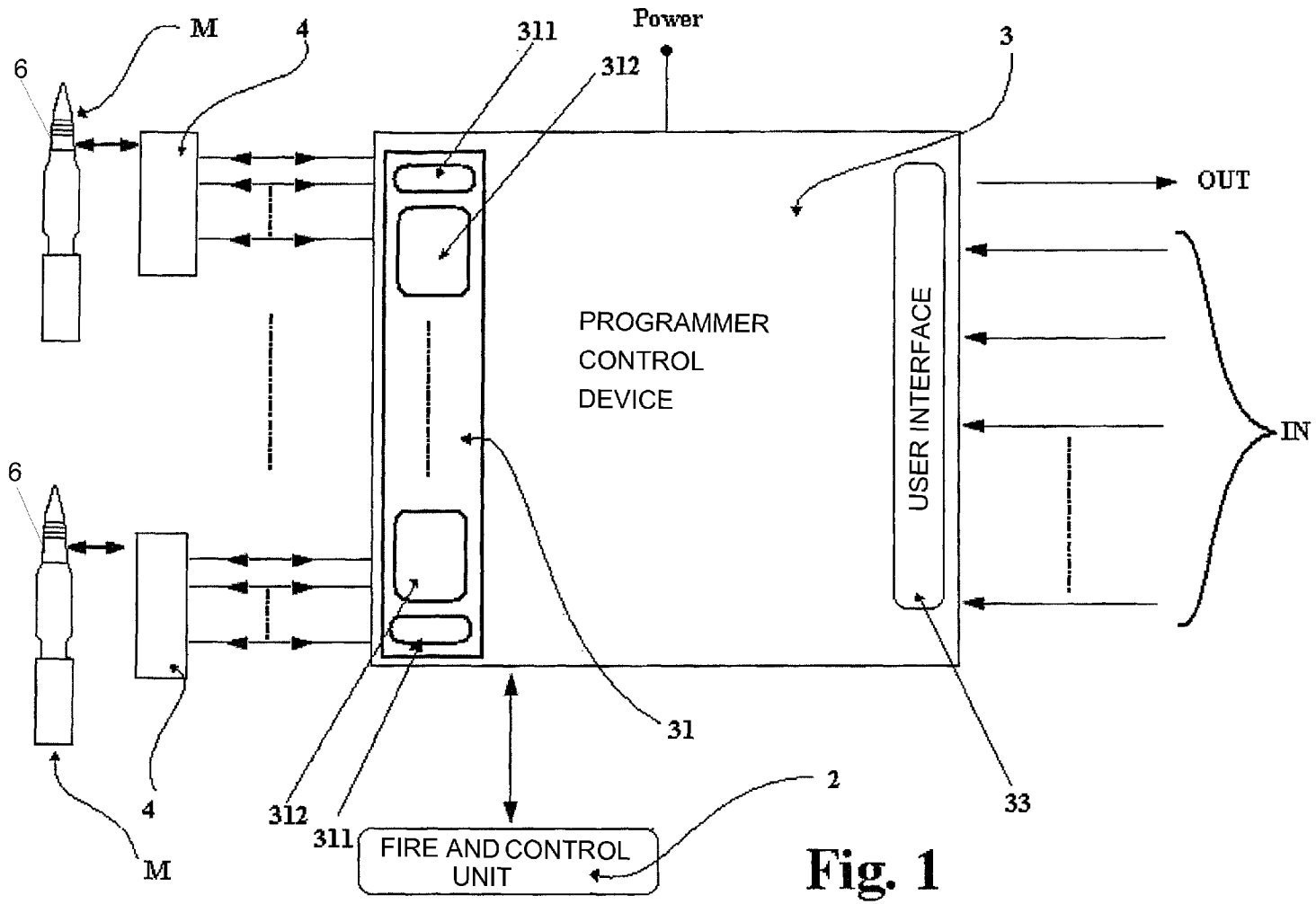
FIG. 1 illustrates the conceptual block diagram of the electronic programming system of the detonating fuses according to the present invention.
Figure 2A:
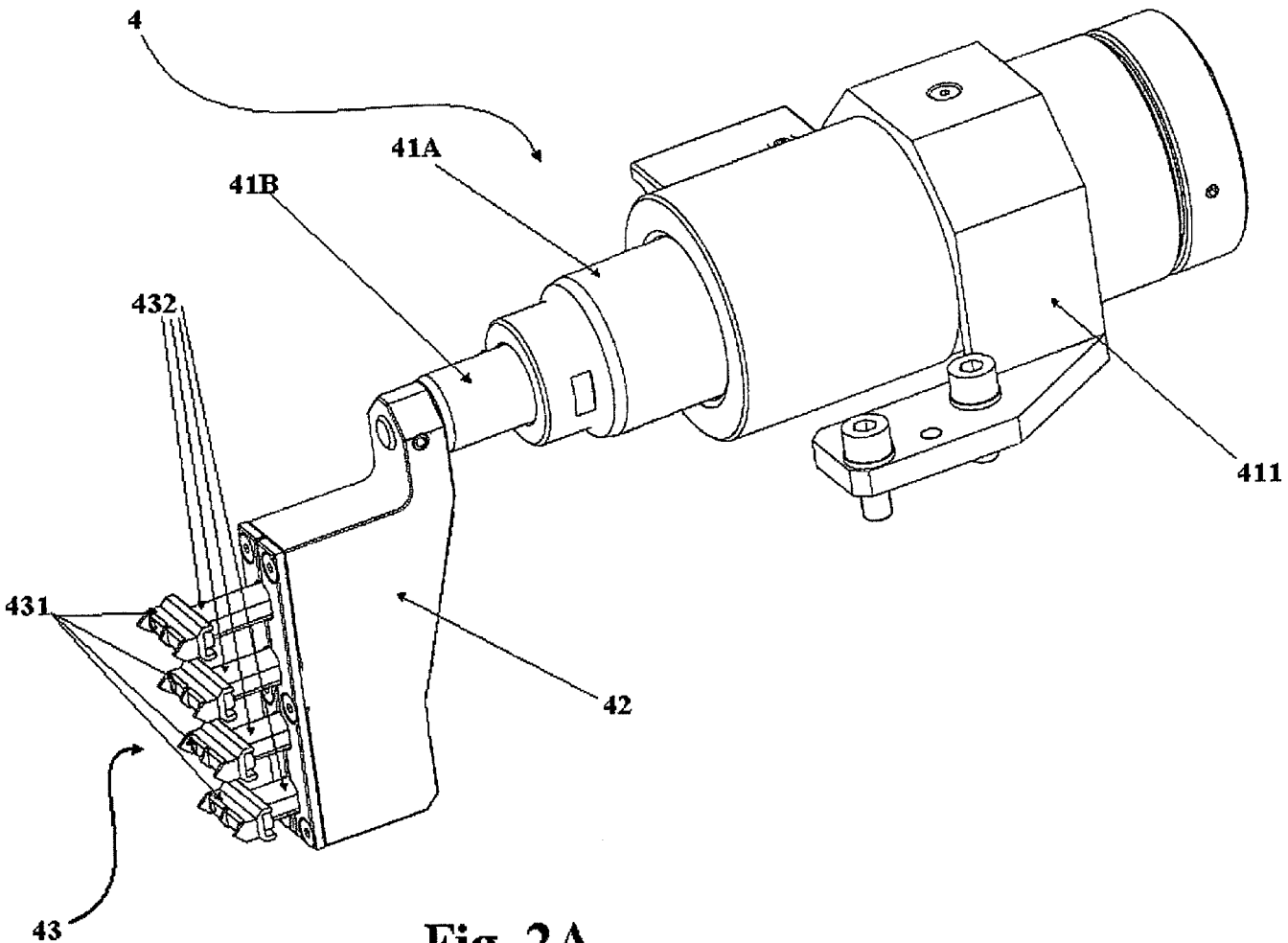
FIGS. 2A, 2B and 2C illustrate the actuation mechanism according to the present invention, respectively FIG. 2A in the resting position in a perspective view, FIG. 2B in the data communication position in a perspective view in accordance with that of FIG. 2A, while FIG. 2C in an intermediate position between the previous ones in a different perspective view.
Figure 2B:
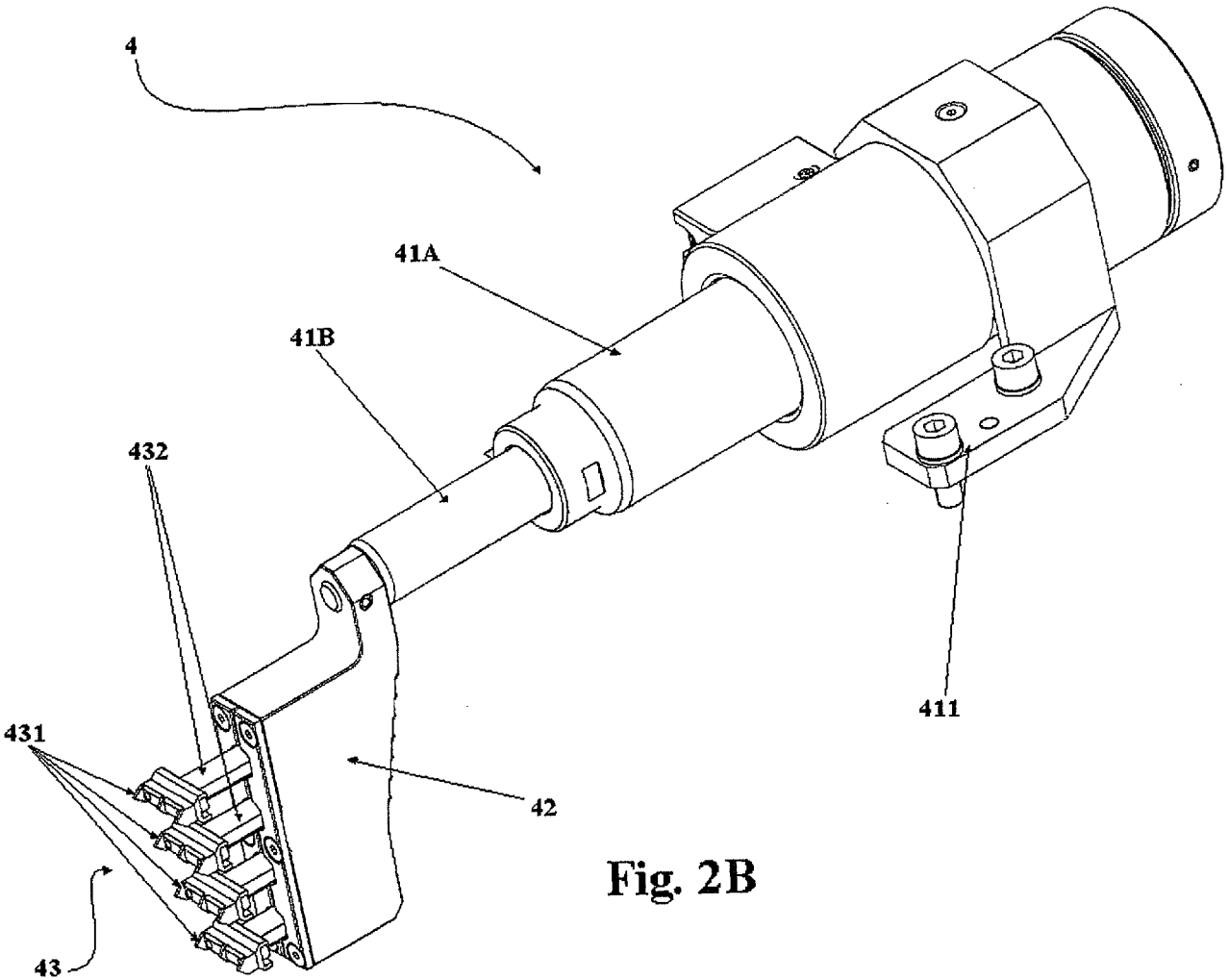
Figure 2C:
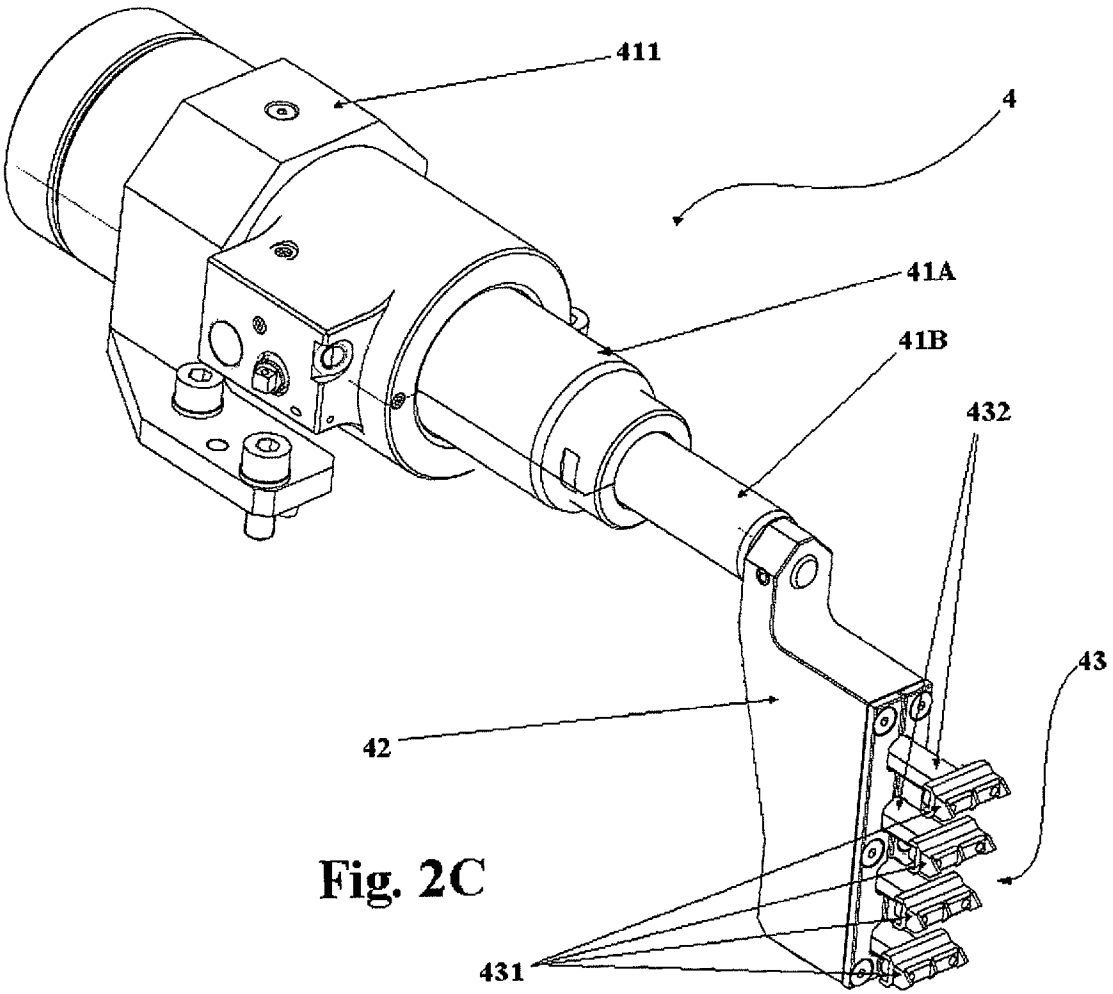
Figure 3:
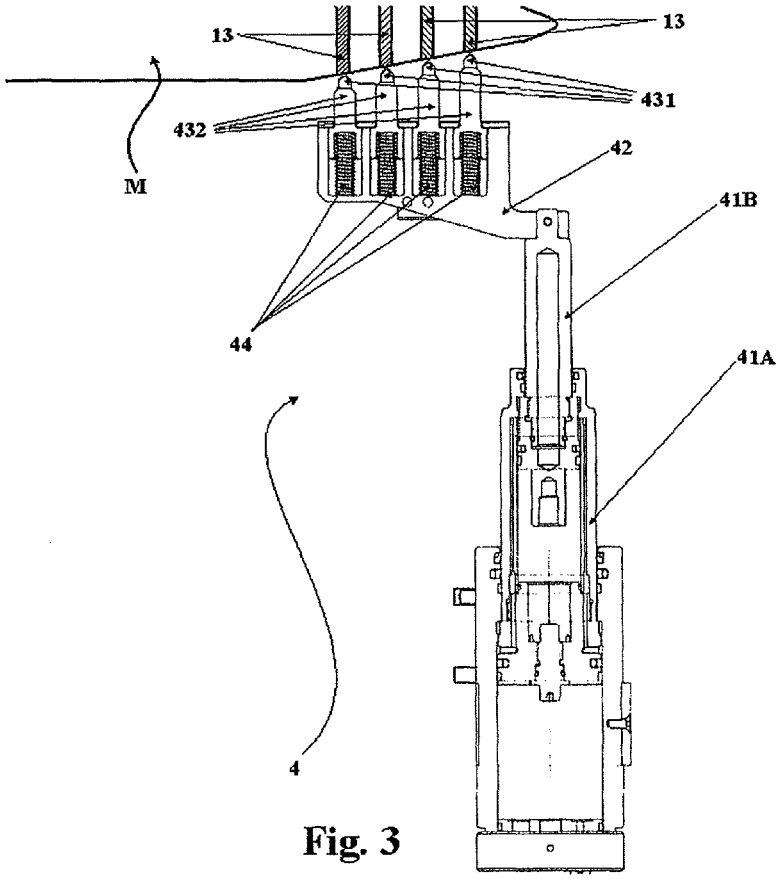
FIG. 3 illustrates, in detail, the actuator according to the presents invention in a cross-sectional view.

Said programming system is directly implemented inside a firearm 1, comprising at least one firearm-control unit 2, adapted to control all the systems implemented in said firearm. The programming system comprises at least one actuation mechanism 4, adapted to provide an electrical coupling between the detonating fuse 6 and a programmer-control device 3, which, via appropriate interfaces, manages the data flows for communication both with the detonating fuse 6 and with firearm-control unit 2. Actuation mechanism 4 is controlled by programmer-control device 3 in such a way that its movement always occurs in a way synchronous with the mechanisms present in firearm 1, which are managed by firearm-control device 2 and are adapted to enable firearm 1 to deflagrate an ammunition "M". The actuation mechanism is preferably arranged on traversing carriage 11 of firearm 1.

Said actuation mechanism assumes, during its movement, at least two positions:

- a resting position, in which said system does not hamper any of the mechanisms adapted for enabling the firearm 1 to deflagrate an ammunition "M";
- a position of data exchange, in which the position of said actuation mechanism 4 enables electrical connection between the detonating fuse 6 and the programming system for bidirectional transfer of the data.

Said actuation mechanism 4 comprises at least one actuator 41A, 41B, preferably a hydraulic piston, which is fitted to said carriage 11 by means of a support 411, preferably collar-shaped, which surrounds said actuator 41A, 41B fixing it to the firearm.

Actuator 41A, 41B is adapted to longitudinally move at least one supporting structure 42, present in which are a plurality of contact portions 43, which encounter at least as many electrically conductive terminals 13 set on the detonating fuse 6 of the ammunition "M", thus guaranteeing the electrical connection between the two parts. In the descriptive and non-limiting embodiment, each actuation mechanism 4 is of the telescopic type, in which there are two actuators, respectively 41A with the diameter of its larger cylinder and 41B with smaller diameter, coaxial to each other.

Said contact portions are preferably arranged in a comb shape and each of them comprises at least one metal upper portion 431, preferably made of steel, adapted for the electrical conduction, and at least one insulating structure 432, for example made of plastic material. Each contact portion 43 comprises, furthermore, at least one elastic contact means 44, for example a helical spring, adapted to adapt said portion 43 to the surface of the detonating fuse 6, thus guaranteeing a suited contact pressure on electrically conductive terminal 13 during the programming step of the of actuation mechanism 4 in the data exchange position.

The use of said elastic means 44 always guarantees the contact between the parts and the electrical conduction, even in case of jolting of the parts.

Said elastic means 44, in the present embodiment, is arranged inside supporting portion 42, to which it is fitted at one end, while, at the other end, it is fitted to contact portion 43, thus allowing said portion 43 to move along its own longitudinal axis.

Upper portion 431 adheres to terminals 13 during programming, so as to guarantee an electrical conduction, while insulating structure 432, coaxial to elastic means 44, is adapted to insulate and house at least one connection cable, which is adapted to connect said portion 43 to programmer-control device 3.

The lengths of said contact portions 43 are preferably different from one another, so as to follow the profile of the detonating fuse 6, where said terminals 13 are arranged. Once the programming of the ammunition "M" has ended, actuation mechanism 4 is retreated from the data exchange position and reaches the resting position, in which it waits for the arrival of a new ammunition "M" to be programmed. During the above-mentioned movement, in the present embodiment, actuator 41B is retreated faster than actuator 41A.

This speed difference is adapted both to rapidly clear the area, which will be engaged by other devices present in to firearm 1, and to avoid vibrations and damages due to a too fast retreat of actuator 41A.

Said actuation mechanism 4 is preferably arranged in proximity to the breech block of firearm 1, so as to perform the programming right before ramming ammunition "M" itself for being fired.

This solution allows for a very flexible firearm 1, thus permitting a variation of the programming of the ammunitions according to the orders for the battle plan, which vary according to the changes of the operating scenario.

Furthermore, at least one of these actuation mechanisms 4 can be arranged in a hold, preferably a magazine, and be used not for the very programming of the ammunition, but for recognizing the different types of ammunitions "M" stored.

The use of said actuation mechanism 4 in holds or magazines is adapted to accelerate the programming procedure, since there is a prior recognition of ammunition "M", which is inserted in the process which will end with the firing of said ammunition "M".

Said prior recognition allows the data needed for the programming of said ammunition "M" to be prepared before actually carrying out the programming. This solution allows for the elimination of the enquiry step, during which the programming system interrogates the detonating fuse 6 in order to obtain from the detonating fuse 6 itself the information on the characteristics of the ammunition, since this step is previously carried out in parallel with other operations, thus reducing the time needed for the programming and increasing, as a consequence, the firing frequency of said programmable ammunitions "M".

The data sent by the detonating fuse 6 of ammunition "M" towards the programming system are stored, for example, in suited memory media, to which, for example, firearm-control unit 2 can have access, in order for these data to be rapidly collected before the actual programming and sent to programmer-control device 3 right before, or right after, the sending of the authorization signal of the programming.

In a further embodiment, said recognition data of programmable ammunition "M" are directly stored by programmer-control device 3 in suited memory media.

Programmer-control device 3 is adapted to process the data of the mission and to send them to the detonating fuse 6 of an ammunition "M" for the programming of the same.

The programming of ammunition "M" preferably occurs according to two methods:

- direct method, in which programmer-control device 3 processes the data collected by a user interface 33, comprised therein, in which the operator enters the essential data which will be transmitted to ammunition "M";
- stored method, in which the data for the programming of the detonating fuses are properly stored in suited memory media in a moment prior to the moment in which these data are actually transferred to the detonating fuse 6.

User interface 33, comprised in programmer-control device 3, as mentioned above, is adapted to receive the data sent by the operator, which are inherent in the programming to be performed in real time on the detonating fuse 6 of programmable ammunition "M".

Said user interface is preferably bidirectional, generating as an output a summary of the information of the ammunition, for example on a displaying monitor, in such a way that the operator will be able to check on ammunition "M" which the system is about to program and/or on its programming state.

Said information displayed contains, for example, the answers to the interrogations performed by the actuation mechanisms 4 in the magazine at the beginning of the procedure. Programmer-control device 3 is furthermore in communication with firearm-control device 2, which sends the consent to the programming of an ammunition "M", once the previous steps of the devices present in firearm 1 have ended; furthermore, said device 2 can send to device 3 the data stored, which have been collected by means of actuation mechanism 4 arranged in the magazine or hold of a ship, and are inherent in the technical characteristics of ammunition "M" to be programmed, which are useful for the following programming.

The communication between firearm-control device 2 and the programmer-control device preferably occurs by means of an Ethernet network in real time, so as to accelerate the communications and reduce the impact of the communication errors.

Programmer-control device 3 comprises at least one actuation section 31, adapted to interface ammunition "M" with the programming system. Said actuation section 31 is adapted to: manage the movements of actuation mechanism 4 via an actuation-driving circuit 312 comprised therein; communicate with programmer-control device 3, from which it receives the data for programming ammunition "M". This latter operation occurs thanks to at least one interface for ammunitions 311, comprised in said actuation section 31, which is adapted to transfer the data according to an appropriate communication standard, from the programming system to the detonating fuse 6, and vice versa. In the present embodiment, actuation mechanism 4 is activated, as mentioned above, after a programming signal sent by firearm-control device 2 towards programmer-control device 3.

Said signal is generated by device 2, when: the operating steps of the devices present in the firearm have ended and ammunition "M" is correctly arranged in an ammunition holding device 5, for example a loading arm 51, which holds the case of ammunition "M" and leaves the detonating fuse 6 uncovered for the programming.

In the present embodiment, loading arm 51 is used, furthermore, to grip and move said ammunition "M" in proximity to actuation mechanism 4 and, subsequently, to bring it in correspondence to the breech for the ramming and the subsequent firing. Once programmer-control device 3 has received the above-mentioned signal, it moves, by means of driving circuit 312, actuation mechanism 4 as described above.

Once actuation mechanism 4 has reached the data communication position, contact portions 43 adhere to electrically conductive terminals 13 set on the detonating fuse 6 of ammunition "M", thus creating an electrical connection.

Once the electrical connection has been established, a data flow is sent to the detonating fuse 6 itself by means of the interface for ammunitions 311.

The communication between the detonating fuse and actuation section 31 preferably occurs in a serial way, via a field bus, for example a multicast field bus used in the automotive field.

Said field bus preferably transports: the power supply adapted to feed the electronic devices present in the detonating fuse; the data to be transferred in a bidirectional way; timing signal "CK".

This solution allows data to be transferred both in analogue and digital format.

The type of signal sent as described above varies according to both ammunition "M" to be programmed and the type of data sent.

The data transfer methods used in the present invention guarantee an optimal immunity to electromagnetic troubles, which are normally highly remarkable inside an automated firearm.

The transfer of the data is preferably synchronous and different types of timing sources can be used according to the type of ammunition "M" used.

In those ammunitions "M" containing a locating or positioning device, such as a satellite positioning system (GPS), the same timing signal of the positioning device (GOS) itself is used.

Figure 4:
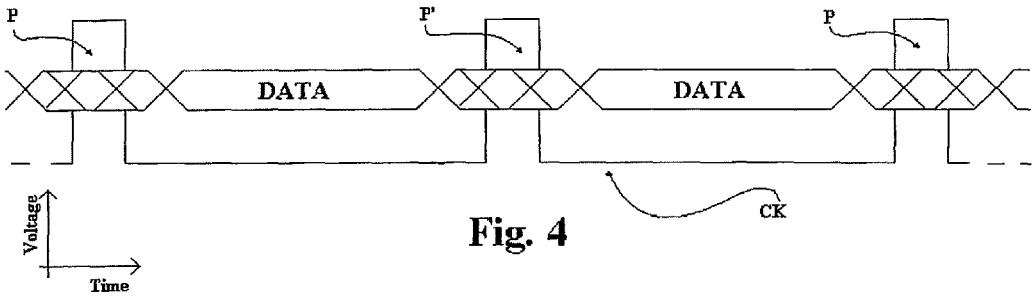
FIG. 4 illustrates a time development of the data flows towards the ammunition and the correct synchronization with the use of a timing signal coming from a positioning system, for example a satellite system (GPS)
Figure 5A:
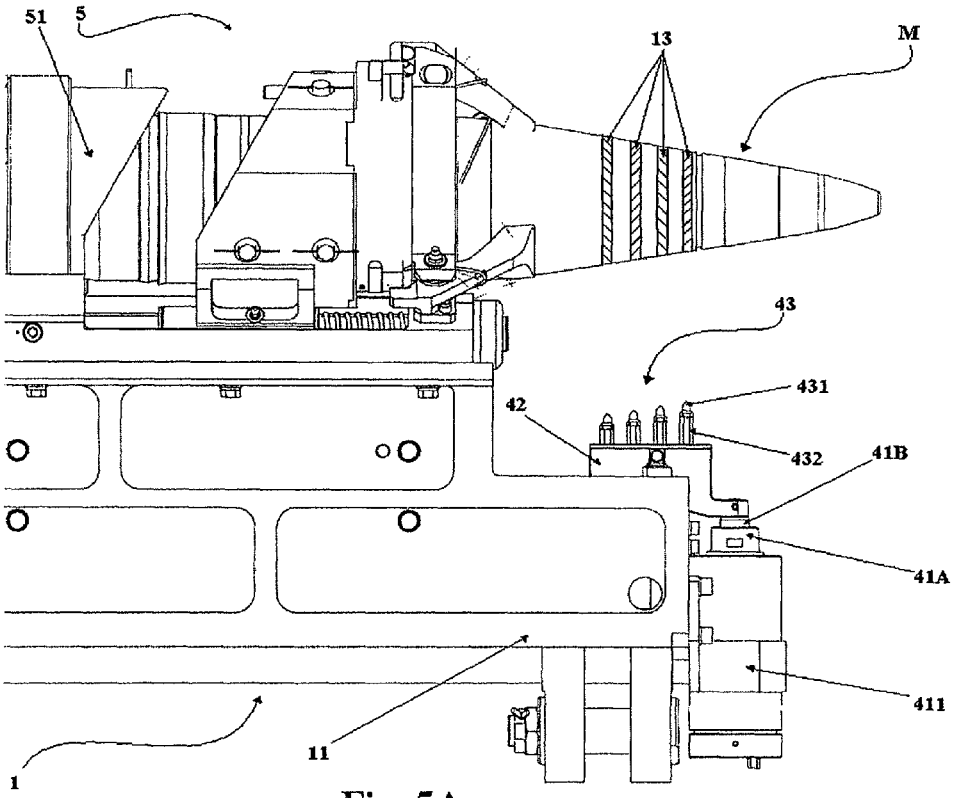
FIGS. 5A and 5B illustrate two applications of the actuation mechanism according to the present invention, which is implemented in two different modes in a firearm. With reference to the above-mentioned figures, the electronic programming system for programmable ammunition "M" is adapted to send information to a detonating fuse of an ammunition "M", which stores the information inside it, and is also adapted to receive information on the characteristics of the ammunition "M" from the detonating fuse itself.
Figure 5B:
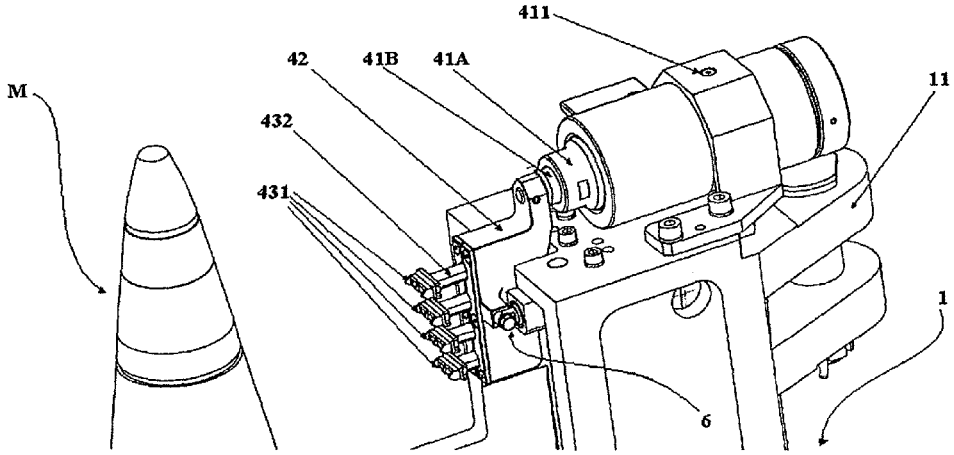

For those ammunitions "M" which do not contain said locating device, a synchronism source is used, which is obtained from an oscillator, for example by using the internal clock of the electronic devices implemented. FIG. 4 shows a synchronization method by means of timing signal "CK" of the locating system.

The method shown is implemented, for example, by inserting portions of code inside a memory device adapted to contain them. Said code portions, executed by means of a processing device comprised in the programming system, are adapted to carry out the following steps: receiving, from the system, a first impulse "P" of a timing signal "CK" coming from the GPS system; sending a data flow with known duration by means of the interface for ammunitions 311 to an ammunition "M" for its programming and vice versa; waiting of the system for a second impulse "P'" and subsequent checking of the data synchronization; correcting the synchronism and sending a new data flow by means of interface 311; waiting for a further impulse "P"; repeating the steps starting from the second one, until the correct data synchronism is obtained; sending the data synchronized by means of said impulse "P" of the timing signal "CK", until the data exchange is completed.

Thanks to this method the interface for ammunitions 311 will keep sending data in the time elapsing between two consecutive impulses "P" and "P'" coming from the timing signal "CK" of the locating system (GPS). The synchronization of the data sending is corrected little by little, until the correct synchronization between the devices is reached based on said timing signal "CK".

The number of impulses "P" necessary for the synchronization is such that it allows the programming time of said ammunition "M" to be reduced, since the sending of the data begins even though the synchronism between the parts is still insufficient.

A further procedure used for the exchange of data between detonating fuses 6 and programming system comprises the following steps: feeding the electronic circuits present in the detonating fuse 6; synchronization of the detonation fuse 6 with the interface for ammunitions 311; exchange of data between the parts.

The above-mentioned steps preferably have to be carried out one after the other, so as to optimize the exchange of data.

Said procedure is preferably implemented in ammunition which do not contain the locating system (GPS).

NUMERICAL REFERENCES

1 Firearm
11 Traversing carriage
13 Electrically conductive terminals
2 Firearm-control unit
3 Programmer-control device
31 Actuation section
311 Interface for ammunitions
312 Actuation-driving circuit
33 User interface
4 Actuation mechanism
41A, 41B Actuator
411 Support
42 Supporting structure
43 Contact portions
431 Metal upper portion

432 Insulating structure
44 Contrast elastic means
5 Ammunition holding device
51 Loading arm
Ammunition M
Synchronization signal "CK"
6 Fuse

The invention claimed is:

1. Electronic programming system for programmable munitions implemented in a firearm, said system adapted to send information to a detonating fuse of an ammunition, which stores the information inside the detonating fuse, and adapted to receive information on the characteristics of the ammunition from the detonating fuse;

said firearm, comprising at least one firearm-control unit, for controlling systems implemented in said firearm;

said electronic programming system comprising at least one actuation mechanism, for providing an electrical coupling to the detonating fuse, and a programmer-control device, which, via interfaces, manages data flows for communication both with the detonating fuse and with the firearm-control unit;

wherein the actuation mechanism is controlled by the programmer-control device such that movement of the actuation mechanism is always synchronous with the systems implemented in said firearm, which are managed by the firearm-control device and adapted to enable the firearm to deflagrate an ammunition; and at least one actuation section, from which the programmer-control device receives the data for programming the ammunition, to manage the movements of the actuation mechanism via an actuation-driving circuit comprised therein and to communicate with the programmer-control device.

2. The programming system according to claim 1, wherein the actuation mechanism comprises at least one actuator, for moving longitudinally at least one supporting structure, present in which are a plurality of contact portions, which encounter at least as many electrically conductive terminals set on the detonating fuse of the ammunition, guaranteeing the electrical connection between the actuation mechanism and the ammunition.

3. The programming system according to claim 1, wherein the actuation mechanism assumes at least two positions: a resting position, in which said system does not hamper any of the mechanisms adapted for enabling the firearm to deflagrate an ammunition; and a position of data exchange, in which the position of said actuation mechanism enables electrical connection between the detonating fuse and the programming system for bidirectional transfer of the data.

4. The programming system according to claim 1, wherein the actuation mechanism comprises at least one interface for munitions which is adapted for transferring the data, from the electronic programming system to the detonating fuse, and vice versa.

5. The programming system according to claim 4, wherein communication between the detonating fuse and the actuation section occurs in a serial way via a multicast field bus.

6. The programming system according to claim 1, wherein the programmer-control device comprises at least one user interface, for receiving the data, sent by the operator.

7. The programming system according to claim 6, wherein the user interface is bidirectional, generating at output a summary of information of the ammunition in such a way that the operator is able to check on the ammunition that the electronic programming system is about to carry out programming and/or is able to check a programming state.

* * * * *